United States Patent [19]

Wagner et al.

[11] 4,299,002

[45] Nov. 10, 1981

[54] ARRANGEMENT FOR USE ON A VEHICLE FOR TRANSPORTING PORTABLE BRIDGES

[75] Inventors: Gerhard Wagner, Mainz-Lerchenberg; Dieter Nägel, Neu-Ulm; Georg Kessler, Oberwesel, all of Fed. Rep. of Germany

[73] Assignee: Magirus-Deutz Aktiengesellschaft, Ulm, Fed. Rep. of Germany

[21] Appl. No.: 47,583

[22] Filed: Jun. 11, 1979

[30] Foreign Application Priority Data

Jun. 8, 1978 [DE] Fed. Rep. of Germany ..... 2825060

[51] Int. Cl.[3] ..... E01D 15/12

[52] U.S. Cl. ..... 14/2.4; 280/423 R

[58] Field of Search ..... 14/2.4, 2.6, 27, 1; 280/423 R

[56] References Cited

U.S. PATENT DOCUMENTS

| | | | |
|---|---|---|---|
| 2,690,268 | 9/1954 | Woolslayer | 280/423 R |
| 2,703,634 | 3/1955 | Lee | 280/423 R X |
| 3,208,086 | 9/1965 | Gillois | 14/2.6 |
| 3,488,787 | 1/1970 | Soffge | 14/2.4 |
| 3,492,683 | 2/1970 | Wagner | 14/2.4 |
| 3,562,829 | 2/1971 | Soffge | 14/2.4 |
| 3,845,514 | 11/1974 | Wagner | 14/2.4 |
| 3,871,045 | 3/1975 | Bouvet | 14/2.4 |
| 4,049,289 | 9/1977 | Deckrow | 280/423 R |

FOREIGN PATENT DOCUMENTS

| | | | |
|---|---|---|---|
| 2641466 | 3/1978 | Fed. Rep. of Germany | 14/2.4 |

*Primary Examiner*—Nile C. Byers, Jr.

*Attorney, Agent, or Firm*—Becker & Becker, Inc.

[57] ABSTRACT

An arrangement for use on a vehicle, especially truck for transporting portable bridges, with the sections of a portable bridge being adapted to be arranged one above the other on support frames, and being adapted to be received on the support frames, by means of a bridge placing apparatus. The support frames are distributed over the effective length, behind the cab of the particular truck, and secured to the frame or the like thereof. The support frames are provided as independent components, releasably securable to the vehicle frame or to a loading platform, and the support frame immediately adjacent the cab is provided with a pivot drive arrangement for moving the sections of the portable bridge in the longitudinal direction of the vehicle.

13 Claims, 8 Drawing Figures

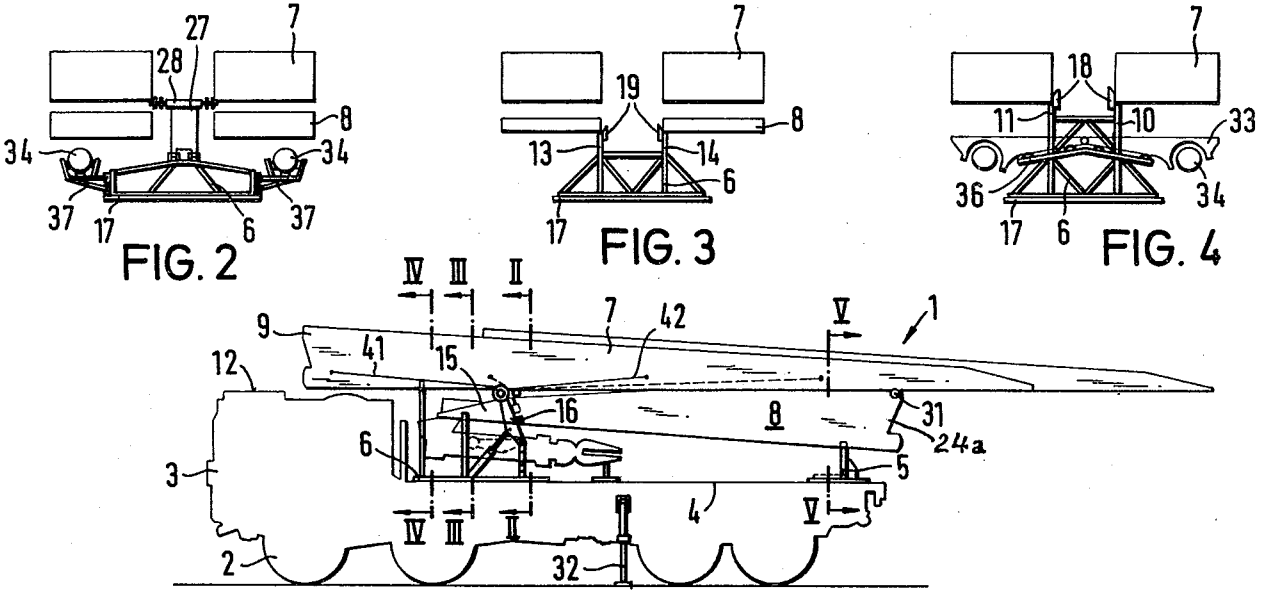
FIG. 1
FIG. 2
FIG. 3
FIG. 4
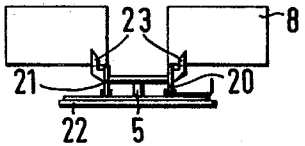
FIG. 5

ARRANGEMENT FOR USE ON A VEHICLE FOR TRANSPORTING PORTABLE BRIDGES

The present invention relates to a vehicle, especially truck for transporting portable bridges, with the components or sections of a portable bridge being adapted to be arranged one above the other on support frames, and being adapted to be received on the support frames, by means of a bridge placing apparatus. The support frames are distributed over the effective length behind the cab of the particular truck on, and secured to, the frame or the like thereof.

In a known vehicle of this type, several cross member-like support structures are secured behind the cab to the vehicle frame over the remaining length of the vehicle. The individual tread members, i.e. the members of the bridge which are to support the wheels of the vehicles to pass over the bridge when installed, are positioned upstanding side by side and edgewise upstandingly on the support structures. A support unit provided for a portable bridge is positioned between the remaining free spaces. The lateral guiding of the components of the bridge is carried out by particular arms which are in contact with the respective members of the bridge lying to the outside.

It is disadvantageous in the arrangement according to the prior art that the vehicle, of necessity, has to be a special vehicle which is only adapted to transport components of portable bridges. A further disadvantage resides therein that the portable bridge is only adapted to be transported when in the disassembled condition. This means that a considerable time loss will be involved. In addition, such special vehicles are expensive to produce and are not readily, economically utilized due to the single function thereof.

It is an object of the present invention to provide a vehicle for transporting portable bridges which avoids the disadvantages of the vehicles according to the prior art.

This object and other objects and advantages of the invention will appear more clearly from the following specification in connection with the accompanying drawings, in which:

FIG. 1 is a side elevational view showing a truck with support frames and a portable bridge in transport position supported on the support frames according to one embodiment of the invention;

FIG. 2 is a section along the line II—II of FIG. 1 showing part of the forward support frame;

FIG. 3 is a section along line III—III of FIG. 1;

FIG. 4 is a section along line IV—IV of FIG. 1;

FIG. 5 is a section along line V—V of FIG. 1 of the rearward support frame;

Figure 7:
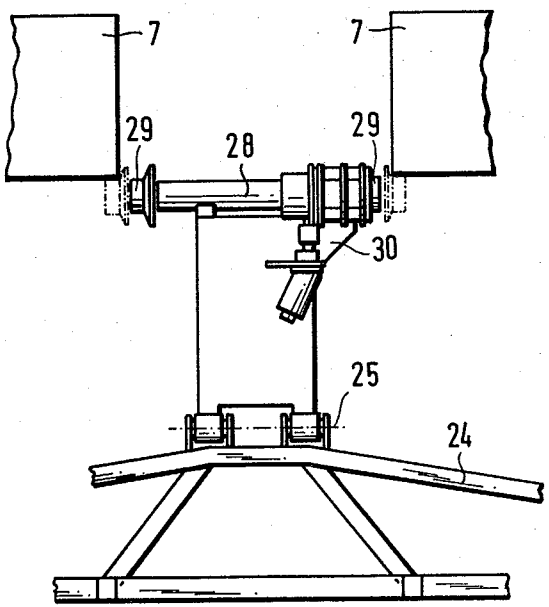
FIG. 7 is an end view of the forward support frame according to FIG. 6.

The present invention is characterized primarily therein that the support frames or structures are formed as independent components which are removably securable to the vehicle frame, or the loading platform secured to the vehicle frame, whereby at the support frame next to the vehicle cab there is provided a pivot drive arrangement for moving the components of the bridge in the longitudinal direction of the vehicle.

The invention provides the advantage that any standard truck with the required load rating, whether it is equipped with or without a loading platform, can be adapted by means of the support frames to serve as a special transport vehicle for transporting a portable bridge. In addition, the advantage is provided that for transport of portable bridges no particular special vehicles are required so that, particularly, a military pool of vehicles including trucks can readily be satisfied with standard and normally used types of trucks. The invention furthermore provides for the advantage that the transfer of the bridge by means of the bridge placing apparatus onto the transporting vehicle can be carried out in a shortest period of time and without delay. This provides the additional advantage that the apparatus for placing the bridge, upon transfer or loading of the bridge onto the receiving vehicle, can then carry out other duties since the further adjustment of the components of the portable bridge is carried out by the means provided on the vehicle.

According to a further embodiment of the invention it is contemplated that a support frame structure comprises a base frame and supports secured thereto which serve as bearing means for the tracks or tread members of the bridge components.

It is further contemplated that the tracks or tread members are supported upon the support members and particularly by the inwardly directed edges of the lower chord profile of the girder or truss of the particular bridge component. Thus, centering of the bridge components in transverse direction to the longitudinal axis of the vehicle can be attained thereby that guide bars are secured to the support members which guide bars in contact inwardly with pertaining leg sections of the lower chord profile. Preferably screws are utilized for the releasable connection between the support frames and the loading platform of a vehicle.

In accordance with another embodiment, it is advantageous when the pivot drive arrangement comprises a support arm which is pivotable about an axis transverse to the longitudinal axis of the vehicle by means of a hydraulic piston cylinder unit, whereby the free end of the support arm includes rolls for the support of the bridge components; the rolls are movable to a point below the lower profile of the track members or track members of the portable bridge.

Shifting of the bridge components on the vehicle is preferably carried out by means of a cable winch which is provided at the free end of the support arm.

When a support unit with support legs is provided for the portable bridge, it is preferred that at the forward support frame, i.e. the support frame or structure closest to the cab of the vehicle, there are provided laterally pivotable carrier members for supporting of the support legs of the support unit.

In accordance with another embodiment of the invention, the forward support frame includes forwardly, in the direction of travel of the vehicle, two support columns extending in height above the roof of the cab of the particular vehicle involved for receiving thereon the attachment end of the upper bridge portion, while in the center of the support frame there is provided a support bearing for the free end of the lower bridge portion.

The free space between the bearing means and the support columns is preferably utilized for the deposition of the transverse head of the support unit.

Since the support unit is not required in all those instances where the bridge is used, it is contemplated that the support unit can be secured to the support frame independent of the bridge components.

In accordance with another embodiment of the invention, the upright support members of the rearward support frame are pivotably mounted on the loading platform. Thus, it is feasible to deposit the bridge from the vehicle for transfer or placing of the bridge initially onto the forward support frame, with the rearward support frame not providing an obstacle.

Referring now particularly to the drawings, as illustrated in FIG. 1, a standard truck 2, normally used for other purposes, serves for transporting a portable bridge generally designated by the numeral 1. The truck 2 is provided with a cab 3 and a loading platform 4 provided behind the cab 3, the loading platform 4 being adapted to serve as an open platform or as a floor in a closed structure. So as to convert the truck to serve as a special transporting vehicle for transporting a portable bridge, there is provided on and close to the rearward end of the loading platform 4, a support frame or support structure 5 and immediately adjacent thereto, behind the cab 3, there is provided a support frame or support structure 6. The support frames 5 and 6 are components which are independent of the truck 2 and which are securable especially for transporting of the portable bridge to the loading platfrom 4, preferably by means of screws, not shown. After transport of the portable bridge to the desired location, the support frames 5 and 6 can be removed from the loading platform 4 so that the truck 2 can be utilized for other purposes as a regular truck.

Figure 8:
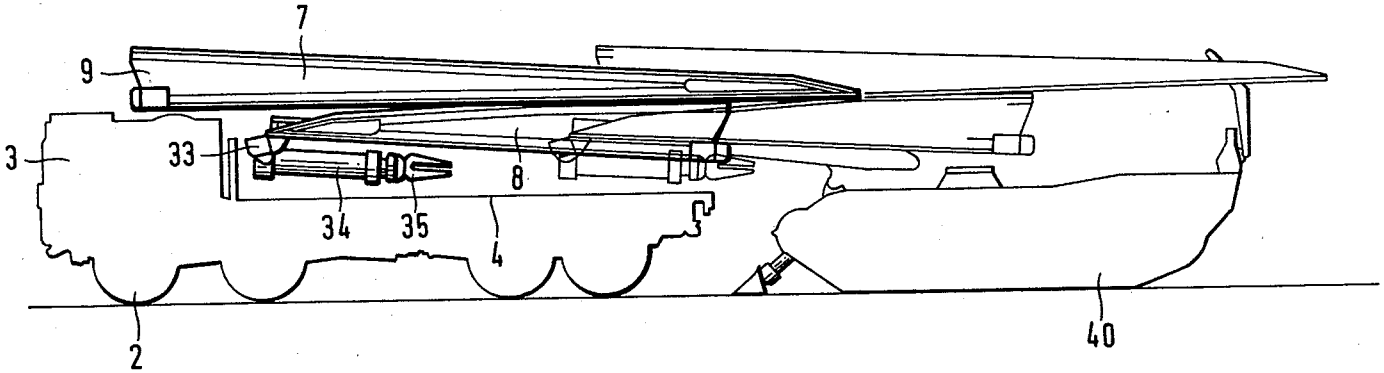
FIG. 8 is a side elevational view which diagrammatically represents the procedure for transfer-loading of the portable bridge from an armored vehicle to a truck.

The portable bridge 1, as is known, comprises two bridge sections 7 and 8 which are adapted to be arranged one above the other. The bridge section 8 which is to lie beneath the upper bridge section 7 is shorter than the upper bridge section 7. However, the particular configuration of the portable bridge 1 is not material to the present invention. The position of the portable bridge 1 on truck 2 corresponds to the so-called transport position which is occupied by the portable bridge 1 when it is on the bridgeplacing apparatus, e.g. the armored vehicle 40, as indicated in FIG. 8.

According to FIGS. 2–4, the forward support frame 6 comprises two upright support columns 10 and 11 having such a length that the upper bridge section 7 with its attachment end 9 can be moved forwardly to extend above the roof 12 of cab 3. Furthermore, the support frame 6 comprises two upright support members 13 and 14 (FIG. 3) which serve as the support bearing for the free end 15 of the lower section 8 of bridge 1. For moving of the bridge sections in the longitudinal direction or direction of travel of the truck 2, there is provided a pivot drive arrangement or unit, generally designated by the numeral 16, operatively connectible to the support frame 6 (FIG. 2). The three elements of the forward support frame 6 just described are provided on a common frame 17 which is positioned and secured on the loading platform 4. The portable bridge 1 includes two track beams or tread beams, i.e. longitudinal members which are to support the wheels of the vehicles passing over the assembled bridge. The beams are connected to each other by means of transverse braces, not shown. The distance between the individual support members 10 and 11, and 13 and 14 is selected so that the tread members positioned with the inwardly directed edges of their lower chord profile of truss or girder are in contact on the support members therewith. For lateral guiding of the bridge sections 7 and 8, guide bars 18 are secured to the support columns 10 and 11, while guide bars 19 are secured to the support members 13 and 14 which guide bars 19 are in contact at the corresponding inner leg sections of the lower chord profile of the pertaining bridge section.

The rearward support frame 5 also comprises two upright support members 20 and 21 which are suitably braced relative to each other and which are pivotable relative to frame 22 about an axis transverse to the longitudinal axis of the vehicle. By means of the guide bars 23, the attachment end 24*a* of the lower bridge section 8 is laterally guided. During loading, the support members 20 and 21 are pivoted onto the loading platform 4, according to the dash line drawn position indicated in FIG. 1.

When the portable bridge 1 is securely deposited on the forward support frame 6, the rearward support members 20 and 21 are pivoted upwardly and secured in the upright position to support the end of the portable bridge 1 therewith.

Figure 6:
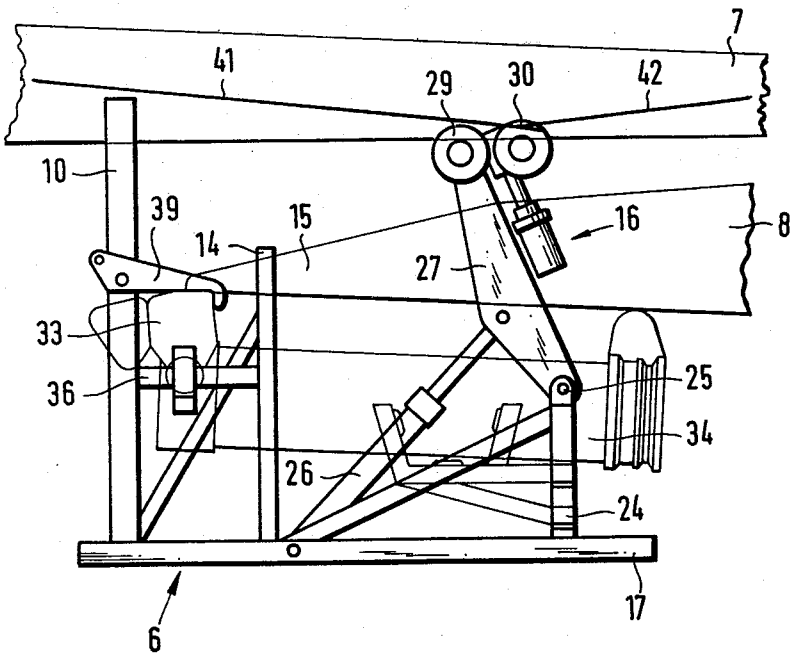
FIG. 6 is a side elevational view drawn to a larger scale of the forward support frame.

According to FIGS. 6 and 7, the pivot drive arrangement 16 comprises a frame 24 of tubular members, with a support arm 27 being pivotally mounted with one end about a pivot 25 having an axis extending transverse to the longitudinal axis of the truck 2 so as to be movable by means of a hydraulic piston-cylinder unit 26. At its upper, free end, the support arm 27 is provided with an axle 28 (FIG. 7) on the ends of which there are mounted laterally shiftable guide rollers 29. In addition, at axle 28 there is provided a cable winch 30 with two rope drums rotating in opposite directions with respect to each other which drums are driven by a hydraulic motor. The shifting of the upper bridge section 7 from the specific transport position on the bridge-placing vehicle 40 in the truck transport-position on truck 2 according to FIG. 1 is required to avoid an excessive rearward projection of the upper bridge section 7, and in order to attain a better positioning of the center of gravity of the portable bridge 1 on truck 2.

For shifting of the upper bridge section 7 relative to the lower section 8 the following steps are carried out: Initially, with the bridge 1 loaded thereon, the bridge-placing vehicle 40 approaches the rearward end of the truck (FIG. 8) and then deposits the bridge on support frames 5 and 6. Then the support arm 27 is pivoted upwardly in clockwise direction whereby simultaneously the rollers 29 are laterally extended so that the upper bridge section 7 is lifted off the forward support frame 6. In addition, the pull ropes 41 and 42 have been secured at opposite ends of the bridge section 7 (FIG. 1). Upon actuation of the cable winch 30, the bridge section 7 can either be moved forwardly in the direction of travel, or opposite thereto towards the rear. In order to reduce the frictional resistance between the bridge sections 7 and 8 during shifting of the upper bridge section 7, at the attachment end 24*a* of the lower bridge section 8, a pair of rollers 31 (FIG. 1) is included in the upper track surface. When the upper bridge section 7 has attained its transport position, the arm 27 is moved downwardly in counterclockwise direction, through a small distance, so that the upper bridge section 7 is in full contact on the forward support frame 6 with the lower profile portion. For securement of the bridge section 7 in longitudinal direction, pull ropes 41 and 42 of the cable winch 30 remain secured to the bridge section 7.

Two support piston cylinder units 32 secured at the vehicle frame between the forward and rearward axles thereof and supported on the loading platform 4 serve to counterbalance unavoidable shocks during the loading of the portable bridge 1.

For traversal of obstacles which are substantially wider than the length of the portable bridge 1 in extended position, as is known, there is used a support unit which is arranged at the forward end of the portable bridge 1, with the forward free end of the bridge being supported relative to the obstacle by intervention of the support unit. According to one aspect of the invention, such a support unit is transported together with the portable bridge 1 on the truck 2. The support unit comprises a cross or transverse head 33 (FIG. 4) and two support legs 34 movably attached thereto, which support legs 34 comprise base plates 35 (FIG. 8) for positioning on the ground. The transverse head 33 is secured by means of bolts, not shown, at the free end 15 of the lower bridge section 8. The support unit is preferably supported at the forward support frame 6 between the support columns 10 and 11 and the support members 13 and 14 on a bearing means or supporting bearing 36 (FIG. 6). For the support of the support legs 34, laterally movable carrier member 37 are provided at the support frame 6 whereby the base plates 35 as shown in FIG. 1 are supported by additional bearings 38 on the loading platform 4. Furthermore, at the bearing means 36, latch means 39 are provided by means of which the support unit can be secured at the forward support frame 6 independently of the portable bridge 1.

The present invention is, of course, in no way restricted to the specific disclosure of the specification and drawings, but also encompasses any modifications within the scope of the appended claims.

What we claim is:

1. An arrangement for use on a convertible load carrying vehicle, especially a truck independently usable also alternately when required for securely transporting portable bridges, said bridges including sections adapted to be arranged one above the other and being adapted to be respectively loaded onto and unloaded from said vehicle from and onto a bridge placing apparatus; said vehicle including a frame, and a cab mounted on the forward end of said frame; said arrangement comprising in combination therewith:

a first independent support frame releasably securable near said cab on said frame of said vehicle for supporting bridge sections;

a pivot drive unit operatively connectible to said first independent support frame for moving sections of said portable bridge in the longitudinal direction of said vehicle; and a second independent support frame releasably securable on said frame of said vehicle at a predetermined distance more remote from said cab than said first independent support frame for also supporting bridge sections.

2. An arrangement in combination according to claim 1, wherein said first and said second independent support frames respectively comprise:

a base frame securable to said frame of said vehicle; and support members connectible to said base frame for providing support surfaces for sections of said portable bridge.

3. An arrangement in combination according to claim 2 wherein said support members support inner edges of profiled members forming part of a lower chord of girder or truss of a bridge section.

4. An arrangement in combination according to claim 3, and further comprising guide members operatively securable to said support members for aligning sections of a bridge transported by said vehicle, said guide members being locatable so as to be in contact with the inner leg section of the profiled member forming part of the lower chord of girder or truss of a bridge section.

5. An arrangement in combination according to claim 2, wherein said vehicle frame includes a loading platform, said base frames of said first and said second independent support frames respectively being securable to said loading platform.

6. An arrangement in combination according to claim 5, wherein said base frames are respectively securable to said loading platform by means of screws.

7. An arrangement in combination according to claim 1, wherein said pivot drive unit comprises:

a support arm mounted so as to be pivotal about an axis extending transverse to the longitudinal direction of said vehicle, said support arm being provided at its free end with rollers for supporting bridge sections; and a hydraulic piston-cylinder assembly for effecting said pivotal movement of said support arm.

8. An arrangement in combination according to claim 7, wherein said support arm is provided at its free end with a cable winch for effecting said movement, of bridge sections in the longitudinal direction of said vehicle.

9. An arrangement in combination according to claim 1, wherein said first independent support frame includes laterally pivotal support members for supporting bridge sections.

10. An arrangement in combination according to claim 2, wherein said first independent support frame includes two pairs of vertical columns, that pair closest to said cab extending in height above said cab for supporting a bridge section, that pair more remote from said cab and centrally mounted with respect to the base frame thereof serving to support a bridge section.

11. An arrangement in combination according to claim 10, wherein between each pair of columns there is a means providing a bearing surface for supporting a bridge section.

12. An arrangement in combination according to claim 10, and including latch means for securing a bridge section to said first independent support frame.

13. An arrangement in combination according to claim 2, wherein said support members of said second independent support frame are pivotally connectible to the base frame thereof.

* * * * *